US012281465B2

(12) United States Patent
Li et al.

(10) Patent No.: US 12,281,465 B2
(45) **Date of Patent: *Apr. 22, 2025**

(54) COMPREHENSIVE CONTROL MOUNTING WALL SEAT FOR SHOWER SYSTEM AND SHOWER SYSTEM

(71) Applicant: Yongqiang Yan, Fujian (CN)

(72) Inventors: Wenjun Li, Fujian (CN); Weilong Luo, Jiangxi (CN); Haihua Su, Fujian (CN); Pingqing Zhang, Xiamen (CN)

(73) Assignee: Yongqiang Yan, Xiamen (CN)

( * ) Notice: Subject to any disclaimer, the term of this patent is extended or adjusted under 35 U.S.C. 154(b) by 527 days.

This patent is subject to a terminal disclaimer.

(21) Appl. No.: 17/681,561

(22) Filed: Feb. 25, 2022

(65) Prior Publication Data

US 2023/0151597 A1 May 18, 2023

(30) Foreign Application Priority Data

Nov. 17, 2021 (CN) ..... 202122813867.7

(51) Int. Cl.

| | |
|---|---|
| ***E03C 1/06*** | (2006.01) |
| ***E03C 1/02*** | (2006.01) |
| ***E03C 1/04*** | (2006.01) |
| ***E03C 1/048*** | (2006.01) |

(52) U.S. Cl.

CPC ..... *E03C 1/066* (2013.01); *E03C 1/0408* (2013.01); *E03C 1/048* (2013.01); *E03C 2001/026* (2013.01)

(58) Field of Classification Search

CPC ..... E03C 1/066

See application file for complete search history.

(56) References Cited

U.S. PATENT DOCUMENTS

2023/0109101 A1* 4/2023 Yang ..... E03C 1/066 285/33

FOREIGN PATENT DOCUMENTS

CN 209989878 U * 1/2020

* cited by examiner

*Primary Examiner* — Christine J Skubinna

(57) ABSTRACT

The present invention discloses a comprehensive control mounting wall seat for a shower system, including: a wall seat body, wherein the wall seat body is provided with an inlet water connection portion, an outlet water connection portion, a vertical pipe mounting portion, and a pressing switch; the inlet water connection portion is connected with one inlet water pipe, the outlet water connection portion is connected with two outlet water pipes, the inlet water connection portion is in communication with the outlet water connection portion, and the pressing switch controls flow channels of the two outlet water pipes to be opened or cut off; the vertical pipe mounting portion is internally provided with a vertical pipe which is used to connect and support a top spray shower head, and tightened or loosened in cooperation with an adjustment piece to realize free adjustment of height.

18 Claims, 4 Drawing Sheets

COMPREHENSIVE CONTROL MOUNTING WALL SEAT FOR SHOWER SYSTEM AND SHOWER SYSTEM

CROSS-REFERENCE TO RELATED APPLICATION

The present application is based on, and claims priority from, Chinese application number CN202122813867.7, filed Nov. 17, 2021, the disclosure of which is hereby incorporated by reference herein in its entirety.

TECHNICAL FIELD

The present invention relates to the field of shower technologies, and in particular to a comprehensive control mounting wall seat for a shower system.

BACKGROUND

Conventionally, existing shower systems adopting an upward water feeding mode typically utilize a three-way valve to connect inlet water to a top spray shower head and a handheld shower head respectively. However, the existing shower systems have the following disadvantages: (1) typically, the top spray shower head is initially assembled with the three-way valve and then fixed together on a surface of a wall, while close attention is paid to aligning a switch handle with a hole located below the top spray shower head, leading to time and labor consumption during the mounting process; (2) the exposed connection pipes of the top spray shower head and the handheld shower head connected in a conventional manner are long, resulting in excess space occupation and a complex and unaesthetic overall visual effect; (3) conventionally, the turning on/off of the shower heads and adjustment of water temperature are both dependent on the switch handle located below; the switch handle is pulled out and pressed down to control the water path to be opened and closed, and rotated left and right to control water temperature; when required to cut off the outlet water temporarily, the water temperature of next outlet water will be inevitably changed, resulting in a poor user experience. Furthermore, when used for too long, a seal ring in the switch handle easily ages, leading to water leakage of the top spray shower head or the handheld shower head; (4) the top spray shower head connected in a conventional manner is not adjustable in height, and therefore various requirements of the users cannot be met.

Therefore, the existing shower systems adopting upward water feeding mode have shortcomings of single function, not adjustable outlet water height and the like.

SUMMARY

In order to overcome the shortcomings of the prior art, there is provided a comprehensive control mounting wall seat for a shower system.

In order to achieve the above object, the present invention provides the following technical solution.

Provided is a comprehensive control mounting wall seat for a shower system, including a wall seat body, where the wall seat body is provided with an inlet water connection portion, an outlet water connection portion, a vertical pipe mounting portion, and a pressing switch.

The inlet water connection portion is connected with one inlet water pipe, the outlet water connection portion is connected with two outlet water pipes, the inlet water connection portion is in communication with the outlet water connection portion, and the pressing switch controls flow channels of the two outlet water pipes to be opened or closed.

The vertical pipe mounting portion is internally provided with a vertical pipe which is used to connect and support a top spray shower head, and tightened or loosened in cooperation with an adjustment piece to realize free adjustment of height.

In some embodiments, the comprehensive control mounting wall seat of the present invention further includes an inlet water support arm, where the inlet water support arm has a first port and a second port, the first port is fixed on a wall and connected into the inlet water pipe, and the second port is in quick fit cooperation with the inlet water connection portion.

In some embodiments, the outlet water connection portion includes a first water distribution chamber and a second water distribution chamber, which are independent of each other and not communicated with each other. The pressing switch for opening or closing inlet water is disposed in each of the first water distribution chamber and the second water distribution chamber. The first water distribution chamber and the second water distribution chamber are communicated with one outlet water pipe respectively. One outlet water pipe is a hose connected to an end of the vertical pipe, and the other outlet water pipe is a hose connected to a handheld shower head.

In some embodiments, the adjustment piece includes a clamp ring and a sleeve pipe. The sleeve pipe has a diameter slightly greater than a diameter of the vertical pipe and has an elastic deformation amount. The sleeve pipe is disposed outside the vertical pipe, and the clamp ring is sleeved around the sleeve pipe and in quick fit cooperation with the vertical pipe mounting portion. If the clamp ring is loosened, the sleeve pipe restores to a state before deformation so as to release the tightening effect on the vertical pipe; and if the clamp ring is tightened, the sleeve pipe shrinks to a state of embracing the vertical pipe tightly, so as to fix the vertical pipe.

In some embodiments, the inlet water connection portion includes a shell and a middle-penetrated inlet water connection rod.

The shell has an inlet water chamber. An end of the inlet water connection rod is fixed at an inner side of the inlet water chamber, and the other end of the inlet water connection rod is docked with an opening of the second port. A self-spin nut is sleeved around a docking position to achieve quick fit cooperation between the second port and the inlet water connection portion.

In some embodiments, the inlet water connection portion further includes a water seal cover.

The inlet water chamber has an opening, a first inlet water hole and a connection rod fixing block are disposed on an inner bottom wall of the inlet water chamber, and the first inlet water hole is in communication with the outlet water connection portion.

The inlet water connection rod has a third port, a fourth port and a first water via. The third port is in fit cooperation with the connection rod fixing block. The second port is provided with an external thread. The fourth port is docked with the opening of the second port. An end of the self-spin nut is rotatably fitted to the fourth port, and the other end of the self-spin nut is thread-mated with the external thread.

The water seal cover includes a sleeve cylinder, an end cover, and a second water via disposed on the sleeve cylinder. The sleeve cylinder is sleeved around the inlet water connection rod to enable the first water via to be opposed in position to the second water via, and the end cover closes an opening of the inlet water chamber.

In some embodiments, the first water distribution chamber includes a first working chamber and a first outlet water chamber in mutual communication. The first working chamber is provided with a second inlet water hole in communication with the inlet water connection portion, and the first outlet water chamber is provided with a first outlet water opening connected with the outlet water pipe. The pressing switch includes a first switching valve core and a second switching valve core. The first switching valve core is disposed inside the first working chamber. A button on the first switching valve core is pressed to open or close a first flow-through path of water flow, which sequentially includes the second inlet water hole, the first switching valve core, the first outlet water chamber, the first outlet water opening and the outlet water pipe.

The second water distribution chamber includes a second working chamber and a second outlet water chamber in mutual communication. The second working chamber is provided with a third inlet water hole in communication with the inlet water connection portion, and the second outlet water chamber is provided with a second outlet water opening connected with the outlet water pipe. The second switching valve core is disposed inside the second working chamber. A button on the second switching valve core is pressed to open or close a second flow-through path of water flow, which sequentially includes the third inlet water hole, the second switching valve core, the second outlet water chamber, the second outlet water opening and the outlet water pipe.

In some embodiments, the wall seat body further includes an outlet water plate. The outlet water plate is provided with through holes corresponding to the first outlet water opening, the second outlet water opening and the vertical pipe mounting portion. The outlet water plate is in a split welding cooperation with the wall seat body, and the outlet water plate and the wall seat body are made of a plastic material.

In some embodiments, the vertical pipe mounting portion includes a pipe holding portion and a fixing portion provided with an internal thread. The clamp ring has a handle portion and a connection portion provided with an external thread. The sleeve pipe is an elastic metal pipe with a gap opened at a side wall. The vertical pipe is penetrated through the pipe holding portion and the fixing portion. The sleeve pipe is sleeved around the vertical pipe and located inside the fixing portion. The connection portion of the clamp ring is sleeved around the sleeve pipe and rotated into the fixing portion through the thread to tighten the sleeve pipe, and the connection portion of the clamp ring is rotated out of the fixing portion to loosen the sleeve pipe.

According to another aspect of the present invention, there is provided a shower system, including the comprehensive control mounting wall seat as described above.

The present invention has the following beneficial effects.

The present invention provides a comprehensive control mounting wall seat for a shower system, which can be mounted fast and easily. Without needing to operate the switch handle, the opening and closing of the handheld shower head and the top spray shower head can be achieved separately or at the same time, and the height of the top spray shower head is adjustable and easily operable.

BRIEF DESCRIPTIONS OF THE DRAWINGS

Figure 1:
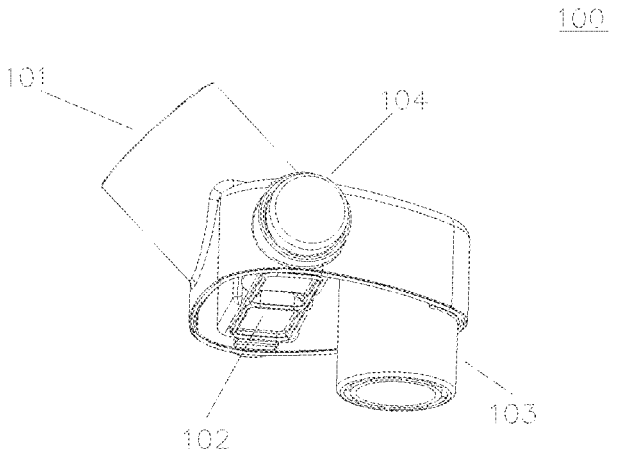
FIG. 1 is a structural schematic diagram illustrating a wall seat body of a comprehensive control mounting wall seat for a shower system according to an embodiment of the present invention.

The implementation of the objects, the functional features, and the advantages of the present invention will be further described in combination with accompanying drawings and specific embodiments.

DETAILED DESCRIPTIONS OF EMBODIMENTS

In order to make the objects, the technical solutions and the advantages of the embodiments of the present invention clearer, the technical solutions of the embodiments of the present invention will be clearly and fully described in combination with accompanying drawings in the embodiments of the present invention. Apparently, the described embodiments are merely some embodiments of the present invention rather than all embodiments. All other embodiments obtained by those skilled in the art based on the embodiments of the present invention without making creative effort shall all fall within the scope of protection of the present invention. Therefore, the following detailed descriptions of the embodiments of the present invention provided in the accompanying drawings are not meant to limit the scope of protection of the present invention, but only represent some preferred embodiments of the present invention. All other embodiments obtained by those skilled in the art based on the embodiments of the present invention without making creative effort shall all fall within the scope of protection of the present invention.

In the descriptions of the present invention, it is noted that, the orientations or positional relationship indicated by the terms "upper", "lower", "inner", "outer", "front", "rear", "both ends", "one end", "the other end", "one surface" and "the other surface" and the like are based on orientations or positional relationship shown in the drawings and are only used for ease of descriptions and simplification of descriptions, rather than indicating or implying that an apparatus or element must have a specific orientation or constructed or operated in a specific orientation. Therefore, the above orientations or positional relationship shall not be understood as limiting of the present invention. Furthermore, the terms "first" and "second" are used for the purpose of description only and shall not be understood as indicating or implying relative importance.

In the descriptions of the present invention, it is noted that, unless otherwise stated clearly, the terms "dispose" and "connect" etc. should be understood in a broad sense, for example, the "connect" may be a fixed connection, or a detachable connection or an integral connection, or a mechanical connection, or a electrical connection or a direct connection or an indirect connection through an intermediate medium, or an internal communication between two elements. Persons of ordinary skill in the art may understand the specific meanings of the above terms in the present invention according to specific situations.

The contents of the present invention will be described below in details in combination with specific embodiments.

Figure 2:
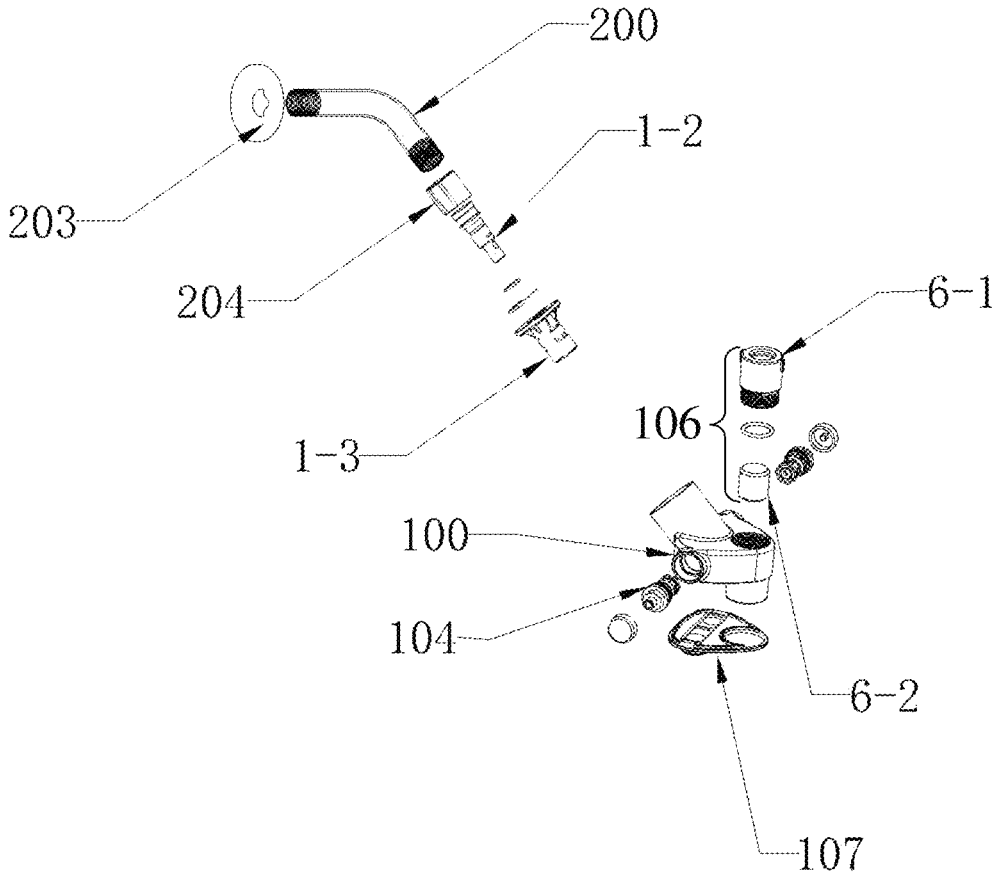
FIG. 2 is an exploded view illustrating a structure of a comprehensive control mounting wall seat for a shower system according to an embodiment of the present invention.
Figure 3:
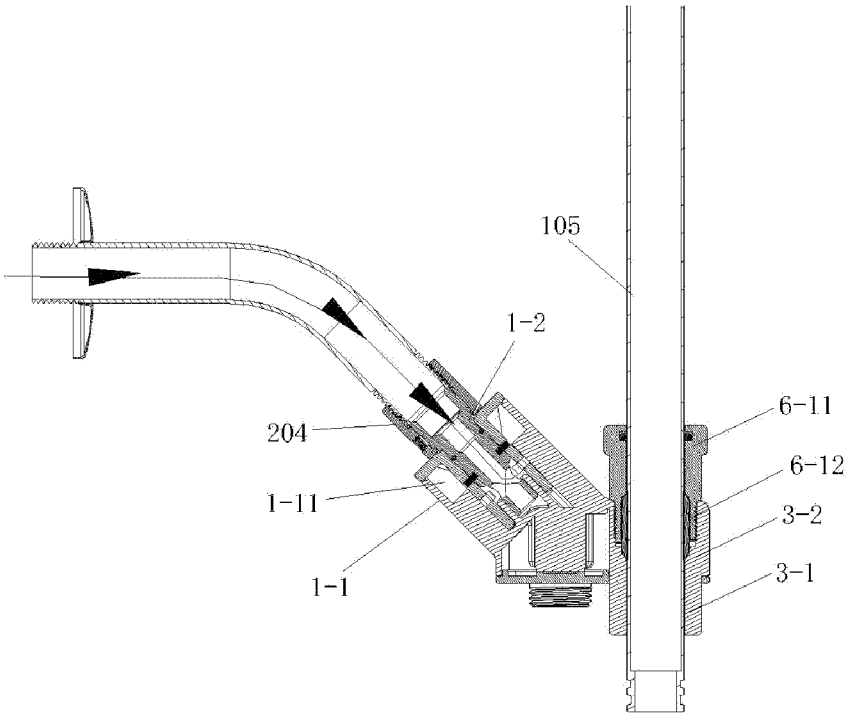
FIG. 3 is a side sectional view illustrating a comprehensive control mounting wall seat for a shower system according to an embodiment of the present invention.
Figure 4:
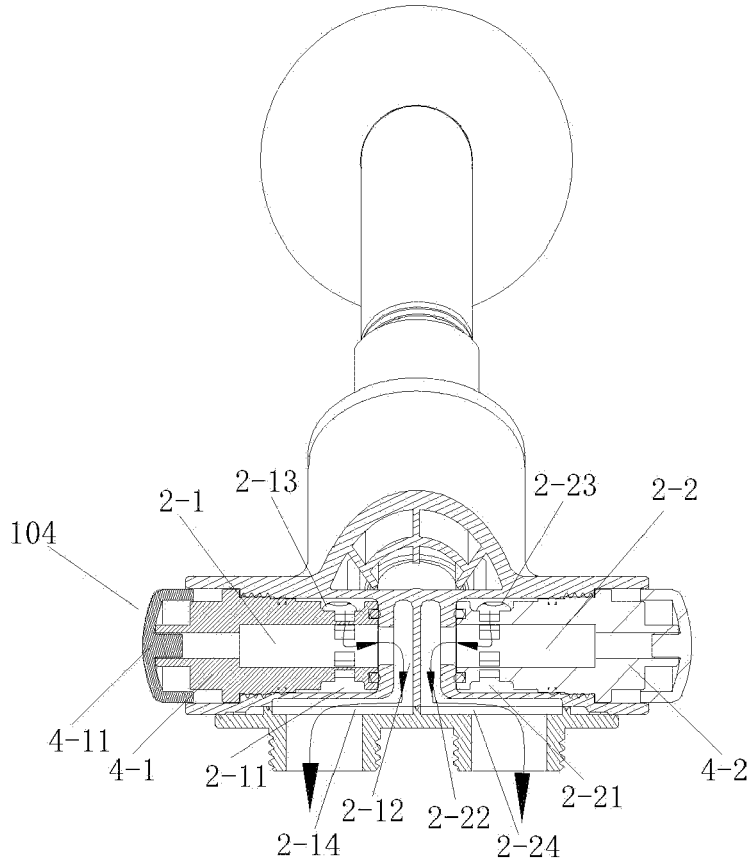
FIG. 4 is a front sectional view illustrating a comprehensive control mounting wall seat for a shower system according to an embodiment of the present invention.
Figure 5:
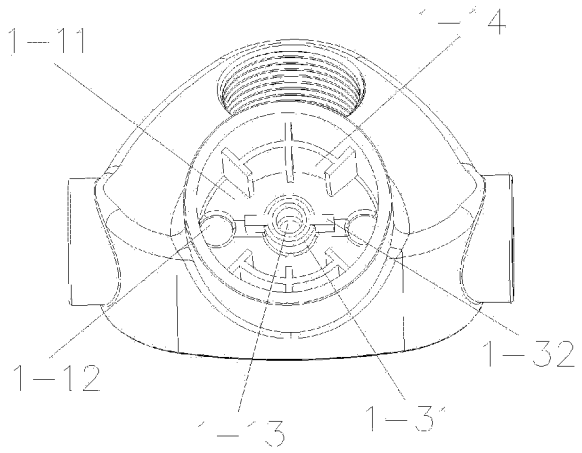
FIG. 5 is a structural schematic diagram illustrating a wall seat body of a comprehensive control mounting wall seat for a shower system from another view angle according to an embodiment of the present invention.
Figure 6:
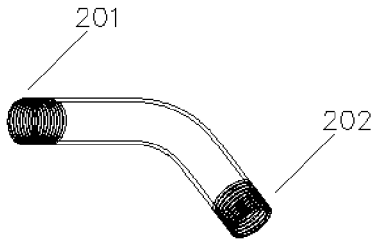
FIG. 6 is a structural schematic diagram illustrating an inlet water support arm of a comprehensive control mounting wall seat for a shower system according to an embodiment of the present invention.
Figure 7:
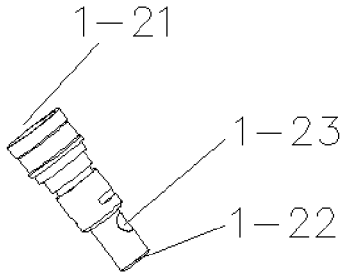
FIG. 7 is a structural schematic diagram illustrating an inlet water connection rod of a comprehensive control mounting wall seat for a shower system according to an embodiment of the present invention.
Figure 8:
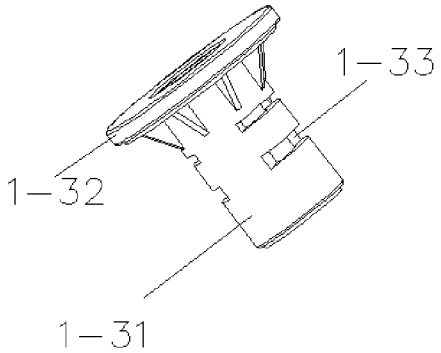
FIG. 8 is a structural schematic diagram illustrating a water seal cover of a comprehensive control mounting wall seat for a shower system according to an embodiment of the present invention.
Figure 9:
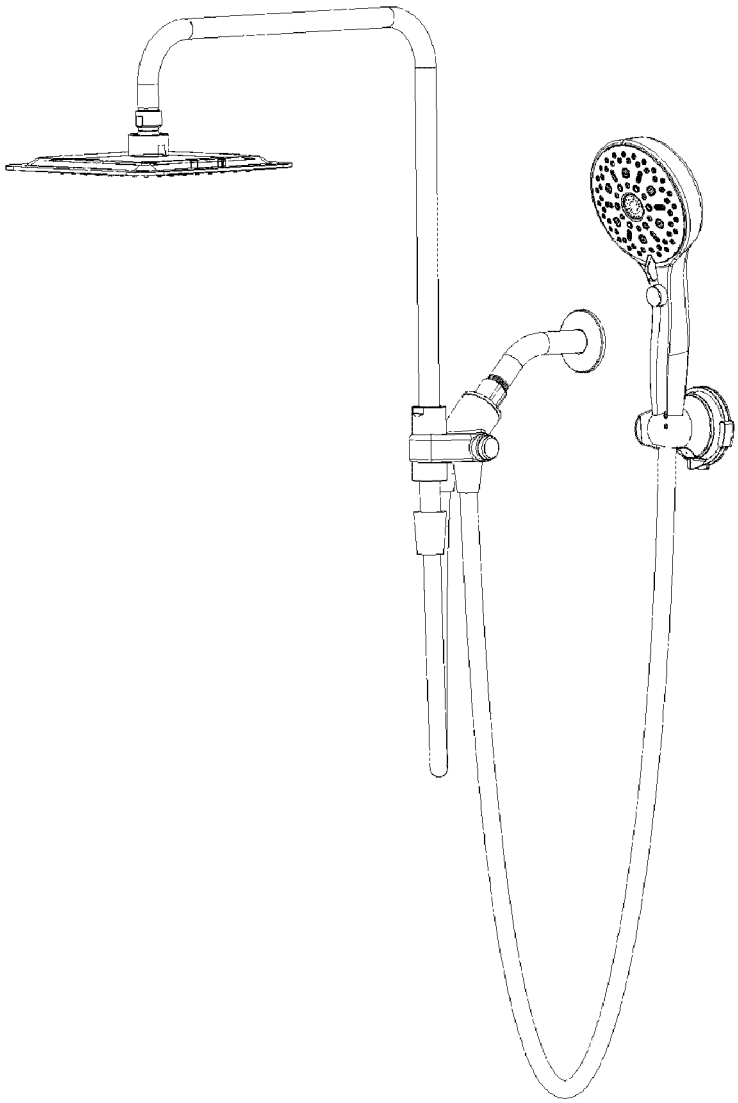
FIG. 9 is an entire structural schematic diagram illustrating a shower system according to an embodiment of the present invention.

With reference to FIGS. 1-9, according to a specific embodiment of the present invention, there is provided a comprehensive control mounting wall seat for a shower system. The comprehensive control mounting wall seat includes a wall seat body 100. The wall seat body 100 is provided with an inlet water connection portion 101, an outlet water connection portion 102, a vertical pipe mounting portion 103, and a pressing switch 104. The inlet water connection portion 101 is connected with one inlet water pipe, and the outlet water connection portion 102 is connected with two outlet water pipes. The inlet water connection portion 101 is in communication with the outlet water connection portion 102, and the pressing switch 104 controls flow channels of the two outlet water pipes to be opened or closed. The vertical pipe mounting portion 103 is internally provided with a vertical pipe 105 which is used to connect and support a top spray shower head, and tightened or loosened in cooperation with an adjustment piece 106 to realize free adjustment of height.

In some embodiments of the present invention, the comprehensive control mounting wall seat further includes an inlet water support arm 200. The inlet water support arm 200 has a first port 201 and a second port 202. The first port 201 is fixed on a wall and connected into the inlet water pipe, and the second port 202 is in quick fit cooperation with the inlet water connection portion 101. Specifically, the inlet water support arm 200 has a horizontal section and an inclined section, both of which form a given included angle, where the included angle may be 100°-150°. The first port 201 on the horizontal section may be connected to the inlet water pipe through thread, and fixedly supported by a flange 203 at the connection position. In some embodiments of the present invention, the inlet water connection portion 101 disposed obliquely forms a preset included angle with a body part of the wall seat body 100 disposed horizontally, where the preset included angle may be in a range of 120°-160° to enable the comprehensive control mounting wall seat to entirely form a stable structure. Preferably, the preset included angle may be about 150°.

In some embodiments of the present invention, the inlet water connection portion 101 includes a shell 1-1 and a middle-penetrated inlet water connection rod 1-2. The shell 1-1 has an inlet water chamber 1-11. An end of the inlet water connection rod 1-2 is fixed at an inner side of the inlet water chamber 1-11, and the other end of the inlet water connection rod 1-2 is closely docked with an opening of the second port 202. A self-spin nut 204 is sleeved around a docking position to achieve quick fit cooperation between the second port 202 and the inlet water connection portion 101.

In some embodiments of the present invention, the inlet water connection portion further includes a water seal cover 1-3. The inlet water chamber 1-11 has an opening. Two symmetric first inlet water holes 1-12 and a connection rod fixing block 1-13 are disposed on an inner bottom wall of the inlet water chamber 1-11, and the first inlet water holes 1-12 are in communication with the outlet water connection portion 102. The inlet water connection rod 1-2 has a third port 1-21, a fourth port 1-22 and a first water via 1-23. The third port 1-21 is in fit cooperation with the connection rod fixing block 1-13. Specifically, the connection rod fixing block 1-13 may include a middle fixing column 1-31 and two fixing plates 1-32 symmetrically disposed at both sides. The third port 1-21 of the inlet water connection rod 1-2 is provided with insertion grooves corresponding to the fixing plates 1-32. The fixing column 1-31 is inserted into a middle through hole of the inlet water connection rod 1-2 and the fixing plates 1-32 are inserted into the insertion grooves to fixedly limit the position of the inlet water connection rod 1-2. The second port 202 is provided with an external thread. The fourth port 1-22 is closely docked with the opening of the second port 202. An end of the self-spin nut 204 is rotatably fitted to the fourth port 1-22, and the other end of the self-spin nut 204 is thread-mated with the external thread. The water seal cover 1-3 includes a sleeve cylinder 1-31, an end cover 1-32, and a second water via 1-33 disposed on the sleeve cylinder 1-31. The sleeve cylinder 1-31 is sleeved around the inlet water connection rod 1-2 to enable the first water via 1-23 to be opposed in position to the second water via 1-33, and the end cover 1-32 closes an opening 1-12 of the inlet water chamber 1-11. Specifically, a fan-shaped limiting rib strip 1-14 is further disposed on an inner bottom wall of the inlet water chamber 1-11 to fixedly limit the sleeve cylinder 1-31. In some embodiments of the present invention, a setting hole is further disposed on a side wall of the self-spin nut 204 for a set screw to penetrate through to realize locking and fixing. An end of the self-spin nut 204 has an inwardly-extending protrusion edge which can be rotatably fitted between a rib strip of an outer sidewall of the inlet water connection rod 1-2 and an outer surface of the end cover 1-32. During operation, water flows through the inlet water support arm 200 into the inlet water connection rod 1-2, and then through the first water via 1-23 and the second water via 1-33 into the inlet water chamber 1-11, and then flows through the first water inlet hole 1-13 on the inner bottom wall of the inlet water chamber 1-11 into the outlet water connection portion 102. During mounting, an operator only needs to rotate the self-spin nut 204 while holding the mounting seal body by hand to enable it to be connected with the second port 202 of the inlet water support arm 200 and then connect the vertical pipe and the outlet water pipes respectively. It features quick accurate aligning, easy operation and less time and labor.

In some embodiments of the present invention, the outlet water connection portion 102 includes a first water distribution chamber 2-1 and a second water distribution chamber 2-2, which are independent of each other and not communicated with each other. A pressing switch 104 for opening or closing inlet water is disposed in each of the first water distribution chamber 2-1 and the second water distribution chamber 2-2. The first water distribution chamber 2-2 and the second water distribution chamber 2-2 are communicated with one outlet water pipe respectively. One outlet water pipe is a hose connected to an end of the vertical pipe 105, and the other outlet water pipe is a hose connected to a handheld shower head.

In some embodiments of the present invention, the first water distribution chamber 2-1 includes a first working chamber 2-11 and a first outlet water chamber 2-12 in mutual communication. The first working chamber 2-11 is provided with a second inlet water hole 2-13 in communication with the inlet water connection portion 101, and the first outlet water chamber 2-12 is provided with a first outlet water opening 2-14 connected with the outlet water pipe. The pressing switch 104 includes a first switching valve core 4-1 and a second switching valve core 4-2. The first switching valve core 4-1 is disposed inside the first working chamber 2-11. A button 4-11 on the first switching valve core 4-1 is pressed to open or close a first flow-through path of water flow, which sequentially includes the second inlet water hole 2-13, the first switching valve core 4-1, the first outlet water chamber 2-12, the first outlet water opening 2-14 and the outlet water pipe. The second water distribution chamber 2-2 includes a second working chamber 2-21 and a second outlet water chamber 2-22 in mutual communication. The second working chamber 2-21 is provided with a third inlet water hole 2-23 in communication with the inlet water connection portion 101, and the second outlet water chamber 2-22 is provided with a second outlet water opening 2-24 connected with the outlet water pipe. The second switching valve core 4-2 is disposed inside the second working chamber 2-21. A button 4-21 on the second switching valve core 4-2 is pressed to open or close a second flow-through path of water flow, which sequentially includes the third inlet water hole 2-23, the second switching valve core 4-2, the second outlet water chamber 2-22, the second outlet water opening 2-24 and the outlet water pipe. In some embodiments of the present invention, the first water distribution chamber 2-1 and the second water distribution chamber 2-2 may be coaxially adjacently disposed and separated by a partition plate, or disposed non-coaxially. The first switching valve core 4-1 and the second switching valve core 4-2 are press-type switching valves with working principle identical to a ballpoint pen press structure. The press-type switching valve may independently control opening or closing of the water inlets of different water distribution chambers, so as to achieve the opening and closing of the handheld shower head and the top spray shower head separately or at the same time. The conventional switching manner cannot achieve simultaneous opening of the top spray shower head and the handheld shower head. Compared with the conventional connection manner, this structure can not only guarantee previously-adjusted water temperature after temporary cut-off of inlet water but also achieve more flexible switching control. Further, in a case of water leakage resulting from failure of a main switch, an alternative switching solution is provided, thus extending its service life and improving user experience.

In some embodiments of the present invention, the adjustment piece 106 includes a clamp ring 6-1 and a sleeve pipe 6-2. The sleeve pipe 6-2 has a diameter slightly greater than a diameter of the vertical pipe 105 and has an elastic deformation amount. The sleeve pipe 6-2 is disposed outside the vertical pipe 105, and the clamp ring 6-1 is sleeved around the sleeve pipe 6-2 and in quick fit cooperation with the vertical pipe mounting portion 103. If the clamp ring 6-1 is loosened, the sleeve pipe 6-2 restores to a state before deformation so as to release the tightening effect on the vertical pipe 105, and if the clamp ring 6-1 is tightened, the sleeve pipe 6-2 shrinks to a state of embracing the vertical pipe 105 tightly, so as to fix the vertical pipe 105.

In some embodiments of the present invention, the vertical pipe mounting portion 103 includes a pipe holding portion 3-1 and a fixing portion 3-2 provided with an internal thread. The clamp ring 6-1 has a handle portion 6-11 and a connection portion 6-12 provided with an external thread. The sleeve pipe 6-2 is an elastic metal pipe with a gap opened at a side wall. The vertical pipe 105 is penetrated through the pipe holding portion 3-1 and the fixing portion 3-2. The sleeve pipe 6-2 is sleeved around the vertical pipe 105 and located inside the fixing portion 3-2. The connection portion 6-12 of the clamp ring 6-1 is sleeved around the sleeve pipe 105 and rotated into the fixing portion 3-2 through the thread to tighten the sleeve pipe 6-2, and the connection portion 6-12 of the clamp ring 6-1 is rotated out of the fixing portion 3-2 to loosen the sleeve pipe 6-2. Specifically, a first oblique surface is disposed at a lower edge of an outer surface of the sleeve pipe 6-2, and a second oblique surface is disposed at an upper edge of an inner surface of the pipe holding portion 3-1. The first oblique surface and the second oblique surface are cooperated mutually such that the sleeve pipe 6-2 can be supported in a limiting manner after and before being tightened. In some embodiments of the present invention, the clamp ring 6-1 and the sleeve pipe 6-2 are both made of a metal material. The handle portion 6-11 of the clamp ring 6-1 helps a user to tighten or loosen the sleeve pipe 6-2 to realize free adjustment of height of the vertical pipe 105. Specifically, an upper part of the vertical pipe 105 has a bending section, an end of which is provided with a top spray shower head. The first outlet water opening 2-14 or the second outlet water opening 2-24 may be connected to the vertical pipe 105 of the same body through a hose, thus greatly shortening a length of the connection pipe of the top spray shower head, and simplifying the structure.

In some embodiments of the present invention, the wall seat body 100 further includes an outlet water plate 107. The outlet water plate 107 is provided with through holes corresponding to the first outlet water opening 2-14, the second outlet water opening 2-24 and the vertical pipe mounting portion 103. The outlet water plate 107 is in a split ultrasonic welding cooperation with the wall seat body 100, and the outlet water plate and the wall seat body are made of a plastic material.

According to another aspect of the present invention, there is provided a shower system, including the comprehensive control mounting wall seat, the handheld shower head, the top spray shower head, and hoses connecting the wall seat body with the handheld shower head and the top spray shower head. Furthermore, the shower system may further include a handheld shower head fixing seat for placing the handheld shower head, where the fixing seat may be fixed to a wall surface by 3M glue or screws or the like.

The working principle of the present invention is as follows: water flows through the support arm into the inlet water chamber and can be switched between water paths by the switching water stopping buttons; if the two valve cores are opened, the handheld shower head and the top spray shower head will deliver water at the same time; if the two valve cores are closed at the same time, water stopping can be achieved; the valve core at one side can be opened to achieve single-function water delivery. With use of hoses, the outlet water openings of the outlet water plate are connected to the handheld shower head and the top spray shower head to deliver water. By adjusting the nut, the sleeve pipe can be loosened or tightened so as to adjust water delivery height of the bending section.

The technical solutions of the above embodiments may be further combined or replaced, and the above descriptions are used only to describe the preferred embodiments of the present invention, rather than limit the idea and scope of the present invention. Various changes and improvements made to the technical solutions of the present invention by those skilled in the art without departing from the design idea of the present invention shall fall within the scope of protection of the present invention.

What is claimed is:

1. A comprehensive control mounting wall seat for a shower system, comprising: a wall seat body, wherein the wall seat body is provided with an inlet water connection portion, an outlet water connection portion, a vertical pipe mounting portion, and a pressing switch;

wherein, the inlet water connection portion is connected with one inlet water pipe, the outlet water connection portion is connected with two outlet water pipes, the inlet water connection portion is in communication with the outlet water connection portion, and the pressing switch controls flow channels of the two outlet water pipes to be opened or closed;

the vertical pipe mounting portion is internally provided with a vertical pipe which is used to connect and support a top spray shower head, and tightened or loosened in cooperation with an adjustment piece to realize free adjustment of height.

2. The comprehensive control mounting wall seat of claim 1, further comprising an inlet water support arm, wherein the inlet water support arm has a first port and a second port, the first port is fixed on a wall and connected into the inlet water pipe, and the second port is in quick fit cooperation with the inlet water connection portion.

3. The comprehensive control mounting wall seat of claim 2, wherein, the outlet water connection portion comprises a first water distribution chamber and a second water distribution chamber, which are independent of each other and not communicated with each other, the pressing switch for opening or closing inlet water is disposed in each of the first water distribution chamber and the second water distribution chamber, the first water distribution chamber and the second water distribution chamber are communicated with one outlet water pipe respectively, one outlet water pipe is a hose connected to an end of the vertical pipe, and the other outlet water pipe is a hose connected to a handheld shower head.

4. The comprehensive control mounting wall seat of claim 3, wherein, the adjustment piece comprises a clamp ring and a sleeve pipe, the sleeve pipe has a diameter slightly greater than a diameter of the vertical pipe and has an elastic deformation amount, the sleeve pipe is disposed outside the vertical pipe, the clamp ring is sleeved around the sleeve pipe and in quick fit cooperation with the vertical pipe mounting portion; if the clamp ring is loosened, the sleeve pipe restores to a state before deformation so as to release the tightening effect on the vertical pipe, and if the clamp ring is tightened, the sleeve pipe shrinks to a state of embracing the vertical pipe tightly, so as to fix the vertical pipe.

5. The comprehensive control mounting wall seat of claim 2, wherein, the inlet water connection portion comprises a shell and a middle-penetrated inlet water connection rod, the shell has an inlet water chamber, an end of the inlet water connection rod is fixed at an inner side of the inlet water chamber, the other end of the inlet water connection rod is docked with an opening of the second port, and a self-spin nut is sleeved around a docking position to achieve quick fit cooperation between the second port and the inlet water connection portion.

6. The comprehensive control mounting wall seat of claim 5, wherein the inlet water connection portion further comprises a water seal cover;

the inlet water chamber has an opening, a first inlet water hole and a connection rod fixing block are disposed on an inner bottom wall of the inlet water chamber, and the first inlet water hole is in communication with the outlet water connection portion;

the inlet water connection rod has a third port, a fourth port and a first water via, the third port is in fit cooperation with the connection rod fixing block, the second port is provided with an external thread, the fourth port is docked with the opening of the second port, an end of the self-spin nut is rotatably fitted to the fourth port, and the other end of the self-spin nut is thread-mated with the external thread;

the water seal cover comprises a sleeve cylinder, an end cover, and a second water via disposed on the sleeve cylinder, the sleeve cylinder is sleeved around the inlet water connection rod to enable the first water via to be opposed in position to the second water via, and the end cover closes an opening of the inlet water chamber.

7. The comprehensive control mounting wall seat of claim 3, wherein, the first water distribution chamber comprises a first working chamber and a first outlet water chamber in mutual communication, the first working chamber is provided with a second inlet water hole in communication with the inlet water connection portion, the first outlet water chamber is provided with a first outlet water opening connected with the outlet water pipe, the pressing switch comprises a first switching valve core and a second switching valve core, the first switching valve core is disposed inside the first working chamber, a button on the first switching valve core is pressed to open or close a first flow-through path of water flow, which sequentially comprises the second inlet water hole, the first switching valve core, the first outlet water chamber, the first outlet water opening and the outlet water pipe;

the second water distribution chamber comprises a second working chamber and a second outlet water chamber in mutual communication, the second working chamber is provided with a third inlet water hole in communication with the inlet water connection portion, the second outlet water chamber is provided with a second outlet water opening connected with the outlet water pipe, the second switching valve core is disposed inside the second working chamber, a button on the second switching valve core is pressed to open or close a second flow-through path of water flow, which sequentially comprises the third inlet water hole, the second switching valve core, the second outlet water chamber, the second outlet water opening and the outlet water pipe.

8. The comprehensive control mounting wall seat of claim 7, wherein, the wall seat body further comprises an outlet water plate, the outlet water plate is provided with through holes corresponding to the first outlet water opening, the second outlet water opening and the vertical pipe mounting portion, the outlet water plate is in a split welding cooperation with the wall seat body, and the outlet water plate and the wall seat body are made of a plastic material.

9. The comprehensive control mounting wall seat of claim 4, wherein, the vertical pipe mounting portion comprises a pipe holding portion and a fixing portion provided with an internal thread, the clamp ring has a handle portion and a connection portion provided with an external thread, the sleeve pipe is an elastic metal pipe with a gap opened at a side wall, the vertical pipe is penetrated through the pipe holding portion and the fixing portion, the sleeve pipe is sleeved around the vertical pipe and located inside the fixing portion, the connection portion of the clamp ring is sleeved around the sleeve pipe and rotated into the fixing portion through the thread to tighten the sleeve pipe, and the connection portion of the clamp ring is rotated out of the fixing portion to loosen the sleeve pipe.

10. A shower system, comprising the comprehensive control mounting wall seat according to claim 1, wherein the wall seat body is provided with the inlet water connection portion, the outlet water connection portion, the vertical pipe mounting portion, and the pressing switch;

wherein, the inlet water connection portion is connected with one inlet water pipe, the outlet water connection portion is connected with two outlet water pipes, the inlet water connection portion is in communication with the outlet water connection portion, and the pressing switch controls flow channels of the two outlet water pipes to be opened or closed;

the vertical pipe mounting portion is internally provided with the vertical pipe which is used to connect and support the top spray shower head, and tightened or loosened in cooperation with the adjustment piece to realize free adjustment of height.

11. The shower system, comprising the comprehensive control mounting wall seat according to claim 10, further comprising the inlet water support arm, wherein the inlet water support arm has the first port and the second port, the first port is fixed on the wall and connected into the inlet water pipe, and the second port is in quick fit cooperation with the inlet water connection portion.

12. The shower system, comprising the comprehensive control mounting wall seat according to claim 11, wherein, the outlet water connection portion comprises the first water distribution chamber and the second water distribution chamber, which are independent of each other and not communicated with each other, the pressing switch for opening or closing inlet water is disposed in each of the first water distribution chamber and the second water distribution chamber, the first water distribution chamber and the second water distribution chamber are communicated with one outlet water pipe respectively, one outlet water pipe is the hose connected to the end of the vertical pipe, and the other outlet water pipe is the hose connected to the handheld shower head.

13. The shower system, comprising the comprehensive control mounting wall seat according to claim 12, wherein, the adjustment piece comprises the clamp ring and the sleeve pipe, the sleeve pipe has the diameter slightly greater than the diameter of the vertical pipe and has the elastic deformation amount, the sleeve pipe is disposed outside the vertical pipe, the clamp ring is sleeved around the sleeve pipe and in quick fit cooperation with the vertical pipe mounting portion; if the clamp ring is loosened, the sleeve pipe restores to the state before deformation so as to release the tightening effect on the vertical pipe, and if the clamp ring is tightened, the sleeve pipe shrinks to the state of embracing the vertical pipe tightly, so as to fix the vertical pipe.

14. The shower system, comprising the comprehensive control mounting wall seat according to claim 11, wherein, the inlet water connection portion comprises the shell and the middle-penetrated inlet water connection rod, the shell has the inlet water chamber, the end of the inlet water connection rod is fixed at the inner side of the inlet water chamber, the other end of the inlet water connection rod is docked with the opening of the second port, and the self-spin nut is sleeved around the docking position to achieve quick fit cooperation between the second port and the inlet water connection portion.

15. The shower system, comprising the comprehensive control mounting wall seat according to claim 14, wherein the inlet water connection portion further comprises the water seal cover;

the inlet water chamber has the opening, the first inlet water hole and the connection rod fixing block are disposed on the inner bottom wall of the inlet water chamber, and the first inlet water hole is in communication with the outlet water connection portion;

the inlet water connection rod has the third port, the fourth port and the first water via, the third port is in fit cooperation with the connection rod fixing block, the second port is provided with the external thread, the fourth port is docked with the opening of the second port, the end of the self-spin nut is rotatably fitted to the fourth port, and the other end of the self-spin nut is thread-mated with the external thread;

the water seal cover comprises the sleeve cylinder, the end cover, and the second water via disposed on the sleeve cylinder, the sleeve cylinder is sleeved around the inlet water connection rod to enable the first water via to be opposed in position to the second water via, and the end cover closes the opening of the inlet water chamber.

16. The shower system, comprising the comprehensive control mounting wall seat according to claim 12, wherein, the first water distribution chamber comprises the first working chamber and the first outlet water chamber in mutual communication, the first working chamber is provided with the second inlet water hole in communication with the inlet water connection portion, the first outlet water chamber is provided with the first outlet water opening connected with the outlet water pipe, the pressing switch comprises the first switching valve core and the second switching valve core, the first switching valve core is disposed inside the first working chamber, the button on the first switching valve core is pressed to open or close the first flow-through path of water flow, which sequentially comprises the second inlet water hole, the first switching valve core, the first outlet water chamber, the first outlet water opening and the outlet water pipe;

the second water distribution chamber comprises the second working chamber and the second outlet water chamber in mutual communication, the second working chamber is provided with the third inlet water hole in communication with the inlet water connection portion, the second outlet water chamber is provided with the second outlet water opening connected with the outlet water pipe, the second switching valve core is disposed inside the second working chamber, the button on the second switching valve core is pressed to open or close the second flow-through path of water flow, which sequentially comprises the third inlet water hole, the second switching valve core, the second outlet water chamber, the second outlet water opening and the outlet water pipe.

17. The shower system, comprising the comprehensive control mounting wall seat according to claim 16, wherein, the wall seat body further comprises the outlet water plate, the outlet water plate is provided with through holes corresponding to the first outlet water opening, the second outlet water opening and the vertical pipe mounting portion, the outlet water plate is in a split welding cooperation with the wall seat body, and the outlet water plate and the wall seat body are made of the plastic material.

18. The shower system, comprising the comprehensive control mounting wall seat according to claim 13, wherein, the vertical pipe mounting portion comprises the pipe holding portion and the fixing portion provided with the internal thread, the clamp ring has the handle portion and the connection portion provided with the external thread, the sleeve pipe is the elastic metal pipe with the gap opened at the side wall, the vertical pipe is penetrated through the pipe holding portion and the fixing portion, the sleeve pipe is sleeved around the vertical pipe and located inside the fixing portion, the connection portion of the clamp ring is sleeved around the sleeve pipe and rotated into the fixing portion through the thread to tighten the sleeve pipe, and the connection portion of the clamp ring is rotated out of the fixing portion to loosen the sleeve pipe.

* * * * *